US005082399A

United States Patent [19]

Frease et al.

[11] Patent Number: 5,082,399

[45] Date of Patent: Jan. 21, 1992

[54] MINE ROOF ANCHOR HAVING ADJUSTABLE RESIN RETAINING WASHER AND EXPANSION SHELL ASSEMBLY WITH FRICTION REDUCING MEANS

[75] Inventors: Jerry E. Frease, Lexington, Ky.; John C. Stankus, Canonsburg, Pa.; Eugene H. Stewart, Pittsburgh, Pa.; Glen S. Grissinger, Hollidaysburg, Pa.

[73] Assignee: Jennmar Corporation, Pittsburgh, Pa.

[21] Appl. No.: 519,010

[22] Filed: May 4, 1990

Related U.S. Application Data

[63] Continuation-in-part of Ser. No. 389,620, Aug. 3, 1989, abandoned, which is a continuation of Ser. No. 229,699, Aug. 8, 1988, Pat. No. 4,865,489.

[51] Int. Cl.[5] ..... E21D 20/02

[52] U.S. Cl. ..... 405/259.6; 405/259.5

[58] Field of Search ..... 405/259, 260, 261

[56] References Cited

U.S. PATENT DOCUMENTS

| | | | |
|---|---|---|---|
| Re. 25,869 | 10/1965 | Schuermann et al. | 405/261 |
| 2,629,908 | 3/1953 | Keck | 24/205 |
| 2,829,502 | 4/1958 | Dempsey . | |
| 2,952,129 | 9/1960 | Dempsey . | |
| 3,702,060 | 11/1972 | Cumming . | |
| 4,195,952 | 4/1980 | Swanson | 405/259 |
| 4,299,515 | 11/1981 | Yates et al. | 405/259 |
| 4,305,687 | 12/1981 | Parker | 405/260 |
| 4,437,795 | 3/1984 | White | 405/261 X |
| 4,490,074 | 12/1984 | Chaiko | 405/261 X |
| 4,501,516 | 2/1985 | Korulla et al. | 405/260 |
| 4,618,291 | 10/1986 | Wright | 405/261 |
| 4,784,530 | 11/1988 | Price | 405/261 X |

FOREIGN PATENT DOCUMENTS

| | | |
|---|---|---|
| 1434225 | 2/1966 | France . |
| 2088509 | 6/1982 | United Kingdom . |

OTHER PUBLICATIONS

"Bethlehem Roof and Rock Bolts", Bethlehem Steel, Catalog 2366-A.

"Bethlehem Mine Roof Bolts and Accessories", Bethlehem Steel, Booklet 325.

*Primary Examiner*—Dennis L. Taylor
*Assistant Examiner*—John Ricci
*Attorney, Agent, or Firm*—S. J. Price, Jr.

[57] ABSTRACT

The mine roof anchor includes a roof bolt assembly with an expansion shell assembly secured at the end of the bolt inserted into the bore hole. The expansion shell assembly includes a friction reducing means to increase the horizontal force on the leaves and the bolt assembly includes an adjustable resin retaining washer to compress the resin in the bore hole.

12 Claims, 5 Drawing Sheets

MINE ROOF ANCHOR HAVING ADJUSTABLE RESIN RETAINING WASHER AND EXPANSION SHELL ASSEMBLY WITH FRICTION REDUCING MEANS

CROSS REFERENCE TO RELATED APPLICATIONS

This application is a continuation, in part of U.S. application Ser. No. 389,620, filed Aug. 3, 1989, entitled "Mine Roof Anchor Having Adjustable Resin Retaining Washer", now abandoned, which in turn is a continuation of U.S. application Ser. No. 229,699, filed Aug. 8, 1988, entitled "Mine Roof Anchor Having Adjustable Resin Retaining Washer", now U.S. Pat. No. 4,865,489.

BACKGROUND OF THE INVENTION

1. Field of the Invention

This invention relates to an improved roof anchor which is partially retained in a rock formation by resin bonding material which has an axially adjustable resin retaining washer that is positionable along the shaft of the roof anchor to retain the resin at the end of the roof anchor and exert a compressive force on the resin before it sets.

This invention also relates to a method and apparatus for increasing the horizontal force produced by a mechanical expansion assembly attached to a mine roof bolt. The invention also reduces the likelihood that the mechanical expansion shell will fail to grip the walls of the bore hole and includes lubricating the surfaces of the leaves of the mechanical expansion shell or the inner plug which expands the shell or both.

2. Description of the Prior Art

It is well known in the art of mine roof support to tension roof anchors in bore holes drilled in the mine roof to reinforce the unsupported rock formation above the roof. Conventionally, a hole is drilled through the roof into the rock formation. The end of the roof anchor is anchored in the rock using either a mechanical expansion shell to grip the walls of the bore hole or by adhesively bonding the anchor with a resin bonding material to the rock formation surrounding the bore hole or by using a combination of a mechanical expansion shell and resin bonding material. When resin bonding material is used, it penetrates the surrounding rock formation to adhesively unite the rock strata and to firmly hold the roof anchor in position within the bore hole. The resin mixture fills the annular area between the bore hole wall and the shaft of the roof anchor.

When a mechanical expansion shell is used in a wet bore hole or together with resin, a problem often develops with "spinners". "Spinners" are mechanical expansion shells which do not expand sufficiently to grip the walls of the bore hole and anchor the bolt assembly within the bore hole.

U.S. Pat. No. 4,419,805 and U.S. Pat. No. 4,413,930 are examples of mine roof anchors utilizing combination of an expansion shell and a resin bonding material to retain the roof anchor within the rock strata. These patents disclose rigid resin retaining washers which are axially fixed to the shaft of the roof anchor and which may not be adjusted after the roof anchor leaves the manufacturing site and is delivered to the mine site.

They also disclose the use of resin to prevent the slippage of the mechanical expansion shell in rock formations such as shale, sandstone, and mudstone after deterioration of the rock formation surrounding the expanding shell has reduced the contact area between the shell and the rock formation.

U.S. Pat. No. 4,162,133 also discloses a roof anchor which is retained within a rock strata by both a mechanical expansion anchor and resin bonding material. This patent discloses a rigid resin retaining washer that is supported on the shaft of the roof anchor by ears that are pinched into the shaft of the roof anchor in a fixed position. The rigid resin supporting washer of this patent is not axially adjustable since the position of the ears pinched into the shaft of the roof anchor will determine the position that the rigid washer assumes when the resin comes into contact with it.

A publication by Bethlehem Steel Company entitled "Bethlehem Roof and Rock Bolts" discloses a resin-anchored roof bolt that has a retaining washer mounted thereon. The bolt is threaded at both ends and the steel washer retains the mixed resin in the bolt hole and also compacts the mixed resin.

U.S. Pat. No. 4,746,248 discloses an anchor bolt anchored by means of resin bonding. Hot-melt adhesive compositions are used as lubricants between the washer and the bolt head and are activated by heat as the bolt is rotated and tensioned in the bore hole. This patent does not disclose the use of mechanical expansion shells.

U.S. Pat. 4,619,559 discloses a friction reducing washer between a nut and the roof plate. The nut is threadedly secured to the end of a bolt extending from the bore hole and the friction reducing washer is utilized to increase the tension on the bolt.

U.S. Pat. No. 4,305,687 discloses the use of a roof anchor system consisting of a roof bolt with one or more wedge portions formed on its upper end. The anchor is secured in place by resin bonding material which is forced into contact with the walls of the hole by the wedged-shaped portion of the anchor. It is stated in this patent that compression is best achieved if the wedged-shaped portions of the bolt do not bond well to the grout. Therefore, coatings such as foil coatings, organic coatings or bonded lubricants such as teflon or molybdenum disulfide are placed on the wedge to allow it to move within the resin without being bound to the resin.

We have found that by providing an axially adjustable rigid resin retaining washer we can accurately coordinate the annular area available for the resin to occupy with the amount of resin that is utilized in the roof anchor system so that when the roof anchor is installed, the upward thrust of the roof anchor will exert a hydraulic force on the resin bonding material to confine it within a restricted annular area at the end of the roof anchor and cause the resin bonding material to be forcefully driven into the cracks and crevices on the inside wall of the bore hole and into the surrounding rock formation to more solidly lock the roof anchor within the rock formation.

We have also found that a lubricated expansion shell assembly increases substantially the horizontal force transmitted to the leaves of the mechanical expansion shell as they grip the walls of the bore hole.

SUMMARY OF THE INVENTION

In accordance with the present invention there is provided a roof anchor for supporting an underground mine roof or the like that includes an elongated shaft having first and second end portions. The shaft first end portion is secured within a blind bore hole formed in the roof by means that include resin bonding material that bonds the shaft first end portion to the inner wall of the bore hole. The shaft second end portion has means cooperating with it to bear against the mine roof around the mouth of the bore hole. An annular stop means is adjustably secured to the elongated shaft at any selected point along the shaft to prevent the resin bonding material from flowing from the shaft first end portion beyond or past the annular stop means before the resin bonding material has set. The stop means is able to withstand the hydraulic pressure created when the elongated shaft penetrates the bonding material before the bonding material has set without the stop means moving longitudinally relative to the shaft.

An expandable shell having a plurality of longitudinally extending leaves, each leaf having an inner surface and an outer surface is positioned on the shaft first end portion. The inner surface of these leaves abut the slanted outer surfaces of a wedged-shaped plug. The plug is threaded onto the threaded upper end of a roof bolt and will move axially upon rotation of the bolt. As the plug moves axially, it pushes the leaves of the expandable shell outward to engage the walls of a bore hole. In order to reduce the friction generated between the expansion shell leaf surfaces and the surface of the plug below the level of the friction generated between the expanded leaves and the walls of the bore hole, a friction reducing means such as a lubricant or a material having a coefficient of friction less than the surfaces of the plug and expansion shell leaves is positioned between the outer surfaces of the plug and the inner surfaces of the expansion shell leaves.

Further, in accordance with the present invention, there is provided a roof anchor for supporting an underground mine roof or the like that has an elongated shaft having first and second end portions. The shaft first end portion is secured within a blind bore hole formed in the roof by a combination of resin bonding material and a mechanical expansion shell surrounding a tapered plug threaded onto the shaft first end portion whereby the expansion shell is expanded to grip the inner wall of the blind bore hole. The mechanical expansion shell is provided with a means to lubricate the inner surface of the expandable leaves of the shell and the outer surface of the plug. The friction reducing means can be a coating applied onto the outer surfaces of the plug and/or the inner surfaces of the leaves or both. A suitable coating or lubricant is Plasti-Dip manufactured by PDI, Inc., 3760 Flower-field Rd., Blaine, Minn. or a hot-melt glue. The friction reduction means especially for a bail-type expansion shell could be a strip or circular disc of polyethylene approximately 1/32" in thickness placed between the outer surface of the plug and the inner surface of the leaves and maintained in place by the bail.

The resin bonding material is in an unmixed condition within a destructible cartridge or capsule that is positioned within the bore hole. The capsule contains an adhesive resin material in a first compartment and a catalyst hardener material in a second compartment so that when the roof anchor is inserted into the bore hole, the capsule is fractured and the components of the two compartments are mixed together by rotation of the shaft and the expansion shell so that the resin bonding material is conditioned to harden and secure elements of the roof anchor to the inner wall of the bore hole.

The shaft second end portion has a bolt head formed on the extreme end that is arranged to contact a roof support plate that bears against the mine roof around the mouth of the bore hole so that the bolt head will exert a tension on the bolt and force the support plate against the roof. An annular stop means is adjustably secured to the elongated shaft at any preselected point along the shaft between the mechanical expansion shell and the bolt head to prevent the resin bonding material from flowing down from the shaft first end portion beyond the stop means before the resin bonding material has set. The stop means is able to withstand the hydraulic pressure created when the roof anchor fractures the destructible cartridge without the stop means moving longitudinally relative to the shaft. The stop means is secured in a selected position on the shaft before the anchor is inserted into the bore hole so that the amount of resin bonding material used to secure the roof anchor to the bore hole will completely fill the space within the bore hole that is not occupied by the roof anchor from the blind end of the bore hole to the stop means and cause the resin to be compressed and a compressive pressure or force to be exerted on the resin bonding material within the bore hole before and during the time the resin bonding material is hardening or setting.

Still further in accordance with the present invention a method is provided for supporting an underground mine roof or the like. A blind bore hole is formed upwardly into the roof. A resin bonding material contained in an unmixed condition within a destructible resin capsule is inserted into the blind hole. A roof anchor system including a mechanical expansion shell and an adjustable annular stop means is provided. A friction reducing means is arranged between the outer surface of the plug and the inner surface of the expansion shell leaves. The adjustable annular stop means is secured onto the roof anchor at a point on the shaft between the ends of the shaft selected to accommodate the size of the destructible resin capsule. The roof anchor is inserted into the blind bore hole and fractures the resin capsule. The bolt is rotated to mix the resin within the bore hole. Further rotation of the bolt moves the plug axially. This axial movement expands the leaves of the shell outward to engage the walls of the bore hole and exert a tension on the bolt. The resin is compressed and permitted to set while under a compressive force. The annular stop means is positioned on the shaft at a point where the resin confined within the blind bore hole by the annular stop means completely fills the space within the blind bore not occupied by the roof anchor and because it is compressed and under pressure is forced into crevices in the inside wall of the blind bore hole.

Accordingly, a principal object of the present invention is to provide a method and apparatus for positioning a rigid annular stop means on a roof anchor shaft so that the stop means is adjustable to accommodate the amount of resin bonding material that will be utilized with the roof anchor due to changing conditions in anchorage strata that could conceivably require adjustment at the mine site and so that the stop means may be placed to exert a compressive force on the resin bonding material before it hardens and sets.

Another principal object of this invention is reduce the occurrences of mechanical expansion shells failing to engage the walls of the bore hole. This is accomplished by preventing complete metal to metal contact between the inner surfaces of the leaves of the expansion shell and the outer surfaces of the plug and thus reducing the friction generated between the inner surfaces of the leaves of the expansion shell and the outer surfaces of the plug as the leaves of the expansion sell are expanded or bent outwardly by the plug.

A further object of the invention is to increase the lateral pressure against the bore hole for a given amount of downward force or torque on the bolt as the plug is being moved downward to expand the leaves of the expansion shell.

These and other objects of the present invention will become apparent as this description proceeds in conjunction with the accompanying drawings and the appended claims.

DESCRIPTION OF THE PREFERRED EMBODIMENTS

Figure 2:
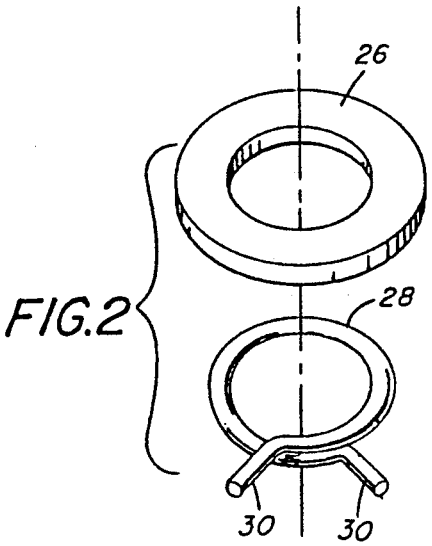
FIG. 2 is an exploded perspective view of the stop means of FIG. 1.
Figure 1:
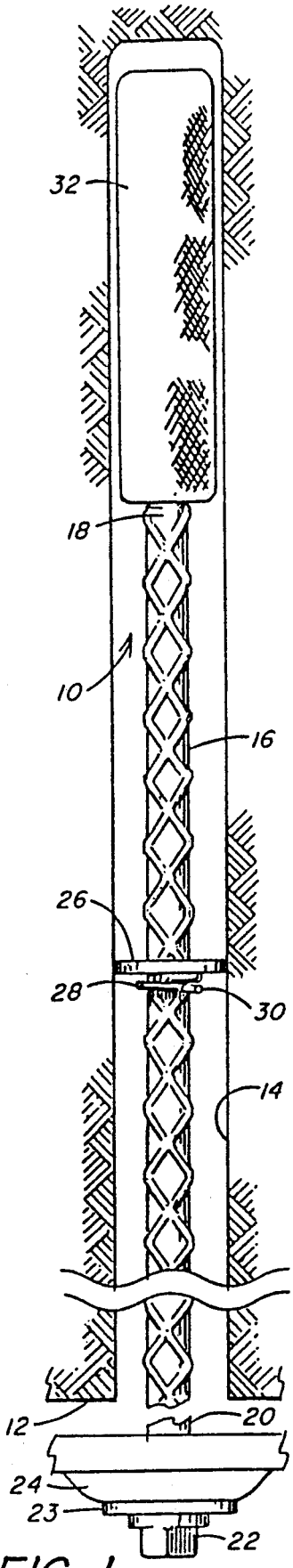
FIG. 1 is a side elevational view of a roof anchor utilizing an adjustable stop means of the present invention positioned within a bore hole in a mine roof.

Referring to the drawings and particularly to FIGS. 1 and 2, there is shown a mine roof anchor 10 that is utilized to support a mine roof 12. A bore hole 14 is formed upwardly into the mine roof 12 and the bolt shaft 16 of roof anchor 10 is positioned within the bore hole 14. The shaft 16 has a first end portion 18 that is inserted into the bore hole 14 first and a second end portion 20 that is positioned near the mouth of the bore hole 14 at the mine roof 12. The shaft second end portion 20 has a bolt head 22 formed thereon. As seen in FIG. 1, the shaft 16 of roof anchor 10 is formed from steel concrete reinforcing the bar.

Immediately adjacent to bolt head 22 a washer 23 surrounds the shaft 16. Washer 23 bears against a roof support plate 24 that abuts the mine roof 12 when the roof anchor 10 is fixed in its final position. At a point between the shaft first end portion 18 and second end portion 20 a rigid annular washer 26 is held in place axially on the shaft 16 by a spring wire clamp 28. The washer 26 fits loosely over the shaft 16 and is of such an outer diameter that the outer periphery of washer 26 extends into close proximity with the wall of bore hole 14.

The spring wire clamp 28 is normally biased to a closed position so that when relaxed it securely clamps about the shaft 16 of roof anchor 10. The spring wire clamp 28 has ears 30 formed thereon so that the ears 30 can be biased toward each other thereby increasing the internal diameter of spring wire clamp 28 so that it may be moved from position to position axially along the bolt shaft 16. Once the spring wire clamp 28 is in the desired position, the washer 26, which is between the first end portion 18 of bolt shaft 16 and the spring wire clamp 28, is positioned against the spring wire clamp 28. When a force is exerted on the washer 26 axially toward the spring wire clamp 28 the spring wire clamp 28 forcefully grips the shaft 16 and prevents axial movement of the washer 26 and the spring wire clamp 28 relative to shaft 16.

Before the roof anchor 10 is positioned within bore hole 14, a resin cartridge or capsule 32 is placed within bore hole 14 above the anchor 10. The resin capsule 32 is a conventional capsule that contains the resin bonding material utilized to bond the shaft 16 within the bore hole 14. The capsule 32 contains the resin bonding material in an unmixed condition within a destructible cartridge or capsule 32. A resin material is contained in one compartment within the capsule 32 and a catalyst hardner material is contained within a second compartment. When the destructible capsule 32 is fractured, the contents within the two separate compartments come together and are mixed by rotation of the shaft 16 of roof anchor 10.

The resin capsule 32 may be obtained in varying sizes containing varying amounts of resin. Similarly, more than one resin capsule may be utilized with one roof anchor depending upon the amount of resin desired to anchor the particular roof anchor 10. The non-homogenous nature of the roof conditions underground, the type of rock formation forming the roof, and the positioning of the roof anchors will all have some bearing upon the amount of resin to be utilized and consequently the amount of adjustability needed on the rigid annular washer 26.

With the arrangement as shown in FIGS. 1 and 2, the rigid annular washer 26 and the spring wire clamp 28 are positioned at a point on the shaft 16 of roof anchor 10 so that the amount of resin in capsule 32 will completely fill the annular space from the end of the bore hole 14 to the annular washer 26 that is not filled by the shaft 16 of anchor 10. With such an arrangement, when the roof anchor 10 is forced up into the bore hole 14 to fracture capsule 32, the rigid annular washer 26 will exert a pressure or compressive force on the soft-pliable resin to force it into cracks and crevices within the interior wall of bore hole 14 to strengthen the anchorage of the roof anchor 10 after the resin sets.

The spring wire clamp 28 must be of such size and spring force as to forcefully clamp the spring wire clamp 28 around the outer surface of shaft 16. When the roof anchor 10 is forced upwardly to fracture capsule 32, substantial hydraulic forces will tend to force washer 26 and spring wire clamp 28 downwardly as viewed in FIG. 1. The strength of spring wire clamp 28 and washer 26 should be sufficient to withstand these hydraulic forces. The rigid annular washer 26 also exerts a compressive force on the soft pliable resin so that in a non-rigid state, the resin is under compression in the bore hole between the top of the bore hole and the rigid annular washer. The resin is maintained under compression by the washer 26 while it rigidifies and sets. Thus, the rigid resin is compressed and it is believed has greater strength than a resin that solidifies without being compressed and under a hydraulic compressive force.

Figure 3:
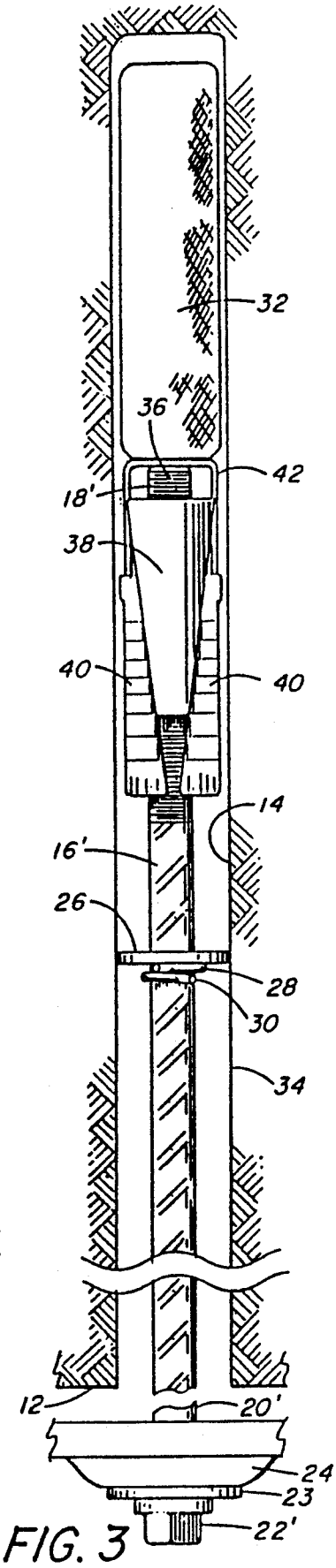
FIG. 3 is a side elevational view similar to FIG. 1 showing the stop means of the present invention utilized on a different type of roof anchor.

Referring now to FIG. 3, there is shown another embodiment of a roof anchor 34 in which similar parts will be identified by the same numeral with a prime (′). The roof anchor 34 has a shaft 16′ that has a first end portion 18′ and a second end portion 20′. The second end portion 20′ has a bolt head 22′ formed thereon. The shaft 16′ of roof anchor 34 is formed with coarse helical thread-like configurations on the outside of the shaft. The first end portion 18′ of shaft 16′ is threaded as at 36 to receive the tapered plug 38 of a bail type shell assembly that cooperates with leaves 40 in a conventional fashion to form a mechanical expansion shell. Leaves 40 are attached to each other by a bail 42 that extends over the end of shaft 16′.

Rigid annular washer 26′ and spring wire clamp 28′, which are identical to those previously described in connection with the embodiment of FIG. 1, are positioned on shaft 16′ and may be adjustably secured at any point between the bottom of the leaves 40 and the second end portion 20′ of shaft 16′. When the roof anchor 34 is positioned within the bore hole 14′, a resin capsule 32′ as previously described is inserted into the bore hole before the roof anchor 34 is inserted. AGain, the position of washer 26′ and spring wire clamp 28′ is adjusted so that the amount of resin in capsule 32′ will fill the space in bore hole 14 between the end of the bore hole and the rigid annular washer 26′ that is not filled by the shaft 16′ and the mechanical expansion shell consisting of tapered plug 38, leaves 40 and bail 42.

Figure 4:
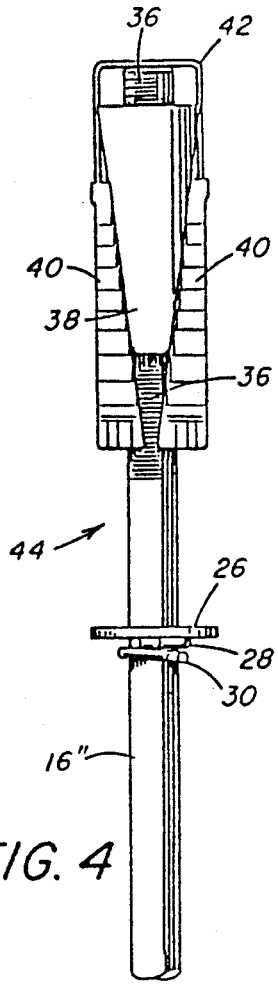
FIG. 4 is a side elevational view of the stop means of the present invention being utilized on a roof anchor having a shaft with a smooth outer surface.

Referring to FIG. 4, there is shown another bail type roof anchor 44 which has a shaft 16″. The shaft 16″ is formed with a smooth external cylindrical surface. In all other respects roof anchor 44 is the same as roof anchor 34 and like reference numerals refer to like parts on both roof anchors 34 and 44.

Referring now to FIGS. 5–10, inclusive, there is shown another form of roof anchor 46. Roof anchor 46 has a shaft 16 formed from a steel concrete reinforcing bar. In FIGS. 5–10, reference numerals which refer to parts that are identical to items already described in connection with FIGS. 1–4 have been given identical reference numerals.

Figure 5:
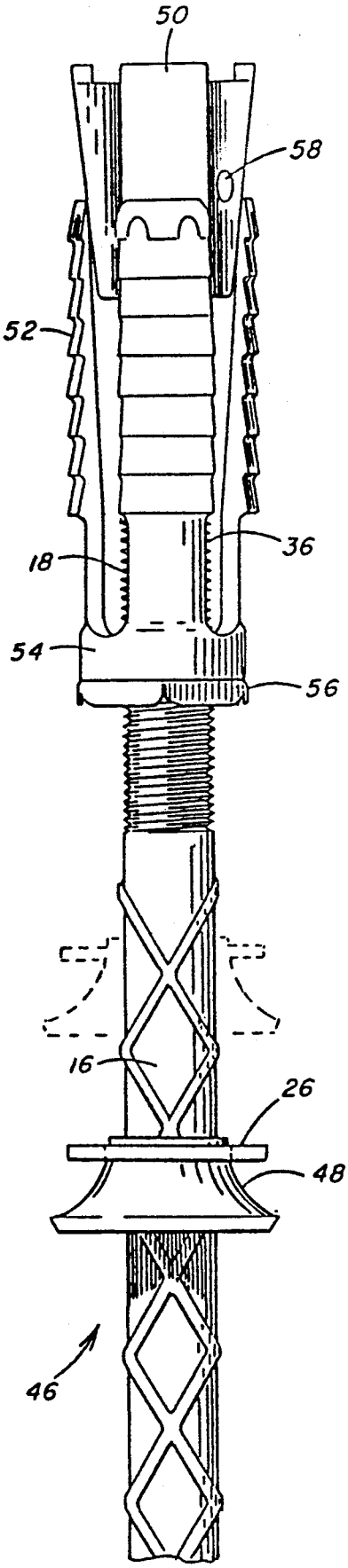
FIG. 5 is a side elevational view of a roof anchor utilizing a second embodiment of the stop means of the present invention.

As shown in FIG. 5, the first end portion 18 of shaft 16 has been threaded at 36 to receive a tapered plug 50 that cooperates with leaves 52 to make up a mechanical expansion shell. Leaves 52 are formed integrally with a ring 54 and are upstanding from ring 54. The ring 54 and leaves 52 are supported on the shaft 16 by a PAL nut or jamb nut 56 that is threaded onto threads 36. The tapered plug 50 has a shear pin 58 that extends through it to delay expansion of the mechanical expansion shell until resin has been mixed by the rotation of the expansion shell and tapered plug as described in U.S. Pat. No. 4,419,805 assigned to the assignee herein.

Figure 6:
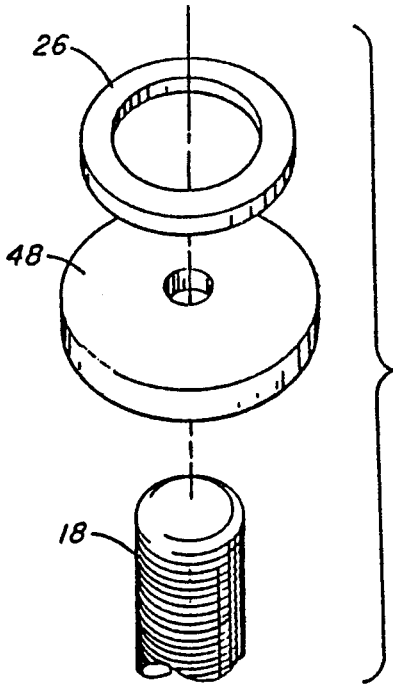
FIG. 6 is an exploded perspective view of the stop means shown in FIG. 5.
Figure 7:
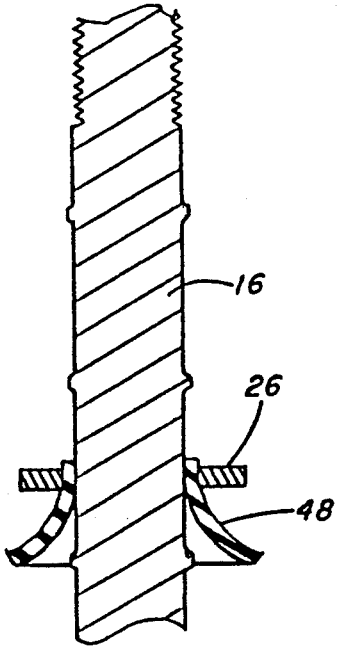
FIG. 7 is a view in longitudinal section of a portion of the roof anchor shown in FIG. 5.

In the embodiments shown in FIGS. 5–10 the rigid annular washer 26 cooperates with a rubber-like washer 48 to fix the annular stop means on the shaft 16 at any desired axial position. As shown in FIG. 6, the rubber-like washer 48 in the relaxed position has a small center hole which must be forced over the shaft 16 of the roof anchor 46. When washer 48 is forced over shaft 16, it deforms to the shape as shown in FIG. 7. The loose-fitting rigid annular washer 26 is then moved down over the shaft 16 and over a portion of the rubber-like washer 48 so that when an axial force is exerted on rigid annular washer 26 that tends to move it toward washer 48, a portion of washer 48 extrudes into and is trapped between the inner portion of rigid annular washer 26 and shaft 16 to force the trapped portion of washer 48 firmly against shaft 16.

Figure 8:
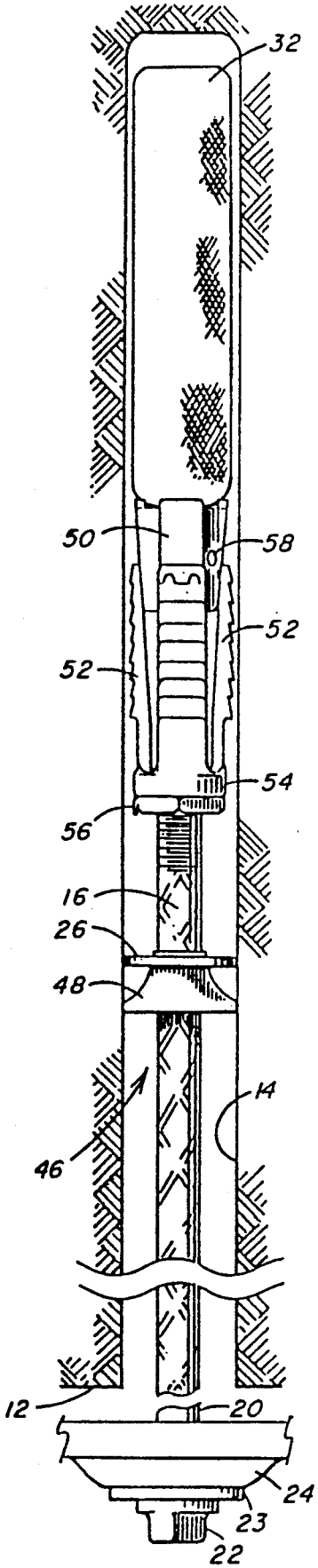
FIG. 8 is a side elevational view of the roof anchor of FIG. 5 positioned within the bore hole of a mine roof before the resin cartridge or capsule is punctured.
Figure 9:
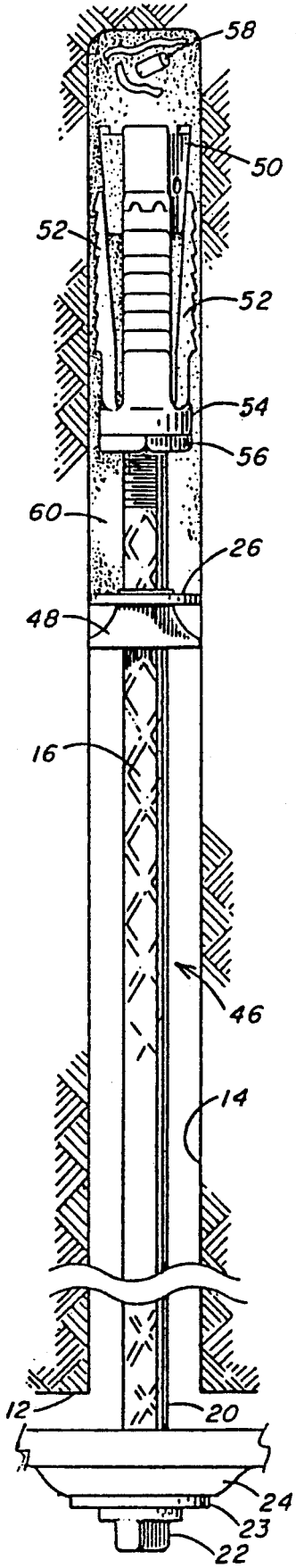
FIG. 9 is an elevational view similar to FIG. 8 showing the roof anchor after the resin capsule has been fractured but before the mechanical expansion shell has been expanded.
Figure 10:
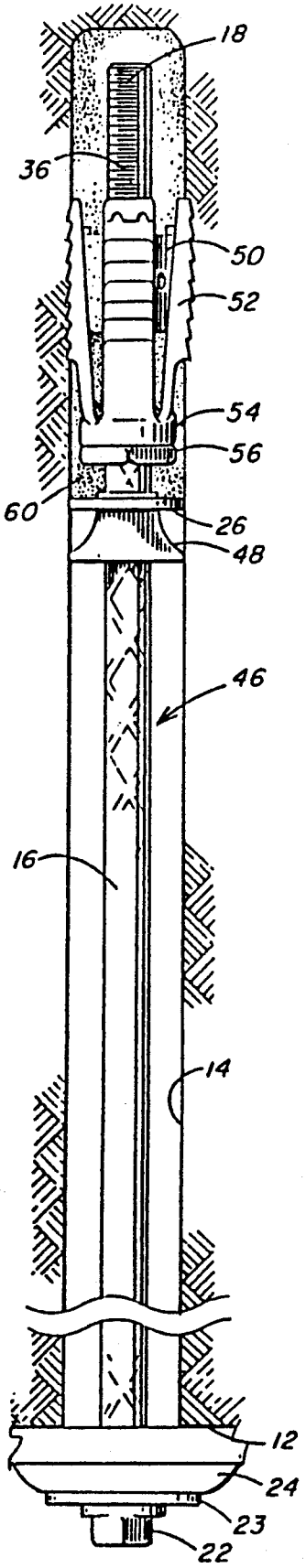
FIG. 10 is an elevational view similar to FIGS. 8 and 9 showing the roof anchor with the expansion shell assembly expanded and the roof anchor under tension.

Referring to FIGS. 8, 9 and 10, it will be seen that the roof anchor 46 is placed into blind bore hole 14 below the conventional resin capsule 32. As in the earlier described embodiments, the rigid annular washer 26 and rubber-like washer 48 are actually positioned on shaft 16 so that the resin within capsule 32 will completely fill the portion of the bore hole 14 from the end of the bore hole to washer 26 that is not occupied by the shaft 16 and the mechanical expansion shell assembly. FIG. 8 shows the roof anchor 46 positioned within the bore hole before the destructible capsule or cartridge 32 has been ruptured. The head 22 of bolt shaft 16 is spaced well away from roof 12 and the washer 23 and roof support plate 24 rest against bolt head 22.

As shown in FIG. 9, the roof anchor 46 has been forced upwardly to rupture capsule 32. Rotation of the shaft 16 and mechanical expansion shell assembly as a unit have caused mixing of the resin 60 which has been released from the capsule 32 and the resin has caused sufficient resistance to rotation of the leaves 52 so as to cause shearing of the shear pin 58 to permit the shaft 16 to be threaded up into plug or wedge 50. It will be noted that the resin 60 from the capsule 32 now completely fills the blind bore hole 14 between its end and washer 26.

FIG. 10 shows the roof anchor 46 with the expansion shell completely expanded so that the leaves 52 are in contact with the bore hole 14 and shaft 16 has been threaded up into wedge 50 to draw the roof support plate 24 into contact with roof 12 by washer 23 and bolt head 22 being carried upwardly by shaft 16. The resin 60 has been trapped between washer 26 and the end of the bore hole 14 and some of the resin has been forced into the cracks and crevices in the surface of bore hole 14.

Figure 11:
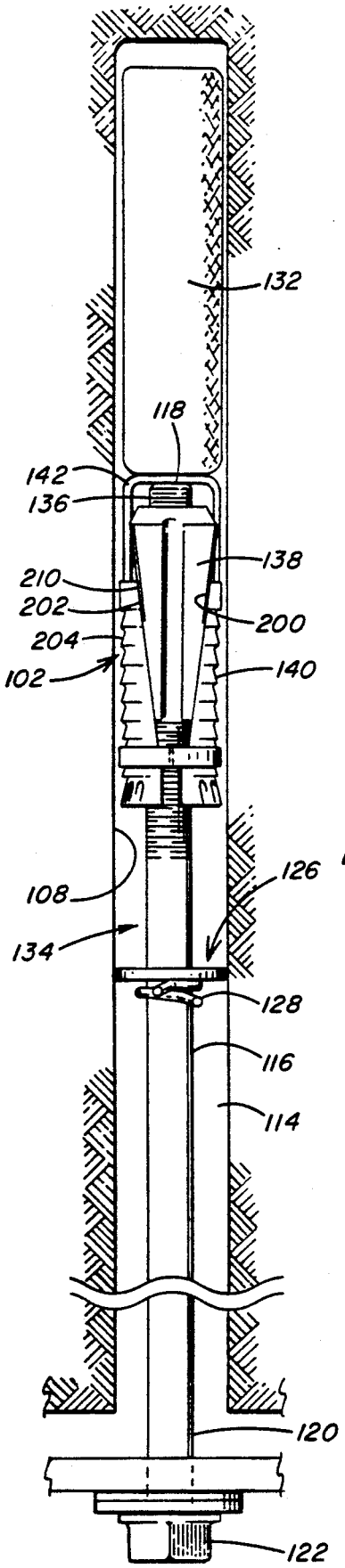
FIG. 11 is a view in elevation of a resin cartridge and a roof bolt assembly including a mechanical expansion shell of the bail type with a friction reducing means between the leaves of the shell and plug and a stop means positioned on the bolt within a bore hole.

FIG. 11 shows a roof bolt or roof anchor assembly 134 with the previously described washer type stop means 126 and a lubricated expansion shell assembly 102 on the roof anchor 134 having a shaft 116 that has a first end portion 118 and second portion 120. The first end portion 118 has a mechanical expansion shell assembly 102 of the bail type threadedly engaged thereon. Leaves 140 of the bail type mechanical expansion shell 102 surround a tapered plug 138. A view of the plug alone can be seen in FIG. 15. The plug 138 is threaded onto a threaded end portion 136 of the bolt first end portion 118. Leaves 140 are attached to each other by a bail 142 that extends over the end 118 of shaft 116.

Rigid annular washer 126 and spring wire clamp 128 which are identical to those previously described in connection with the embodiment of FIG. 1 are positioned on the bolt shaft 116 and may be adjustably secured at any point between the bottom of mechanical expansion shell assembly 102 and the bolt head 122 formed on the second end portion 120 of the shaft 116. When the roof anchor 134 is positioned within the blind bore hole 114, a resin capsule 132 as previously described is placed in the bore hole before the roof anchor assembly 134 is inserted. The position of washer 126 and spring wire clamp 128 is adjusted so that the amount of resin in capsule 132 after it is broken by the bolt assembly 134 fills the space in bore hole 114 between the end of the bore hole and the rigid annular washer 126 that is not occupied by the bolt shaft 116 and the mechanical expansion shell assembly 102.

The roof anchor assembly 134 is thereafter rotated to mix the resin. Rotation continues until the end 118 of the bolt 116 breaks the bail 142 of the mechanical expansion shell assembly 102. Once the bail 142 is broken, the rotation of the bolt 116 causes the tapered plug 138 to move down the threaded end 118 of the roof anchor. This downward motion forces apart the leaves 140 of the mechanical expansion shell 102.

Both the leaves 140 and the tapered plug 138 are formed by a sandcasting process which leaves numerous little nodules which creates a rough surface. These two rough surfaces have a high coefficient of friction and do not slide easily on each other. In certain types of rock formation in which the bore hole is drilled or when the bore hole is wet or when a fluid resin is being used, the friction between the inner surface 200 of the leaves 140 and the outer surface 202 of the plug 138 is greater than the friction between the outer surface 204 of the leaves 140 and the wall 108 of the bore hole 114 and the leaves 140 do not engage the bore hole wall 108 and the plug 138 rotates with the shell 102 and the plug 138 does not move down the threads 136 a sufficient distance to expand the leaves 140 of the expansion shell into gripping relation with the bore hole wall 108. It is believed that the high coefficient of friction between the surfaces of the plug 138 and the expansion shell 140 impede the expansion of the leaves 140 and cause spinners. By providing a friction reducing means 210 between the outer surface 202 of the tapered plug 138 and the inner surface 200 of the leaves 140, the above problem is reduced substantially. The thickness of the friction reducing means 210 should be sufficient to provide lubrication between both surfaces 200 and 202 of leaves 140 and plug 138 respectively. As later described, the friction reducing means on a bail type expansion shell 102 may be a strip or disc of polyethylene or a similar plastic material approximately 1/32" in thickness.

Figure 12:
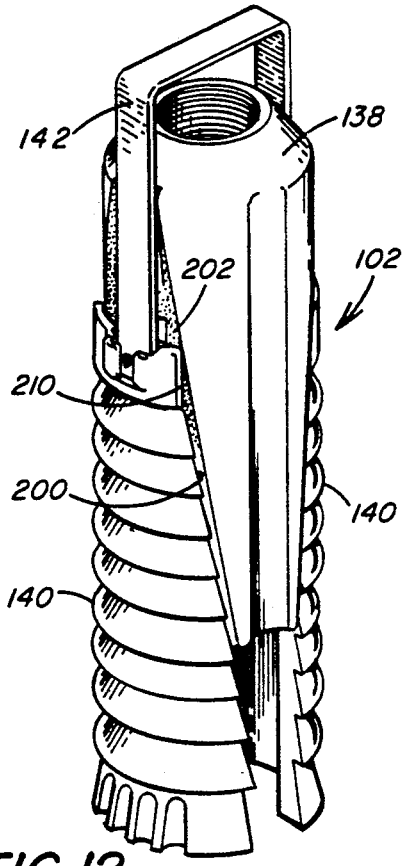
FIG. 12 is a perspective view of a mechanical expansion shell of the bail type with a friction reducing means positioned between the leaves of the shell and the plug.
Figure 13:
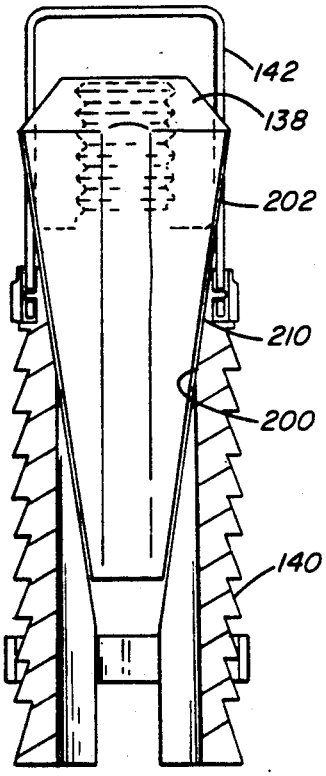
FIG. 13 is a vertical section in elevation of a mechanical expansion shell of the bail type with a friction reducing means between the leaves of the shell and the plug.

FIGS. 12 and 13 illustrate a bail type mechanical expansion shell 102 with the friction reducing means 210 applied to the outer surface 202 of the plug 138. The shell has two longitudinally extending leaves 140, each leaf having an inner surface 200 and an outer surface. The inner surfaces 200 of these leaves 140 abut the sloped or slanted outer surfaces 202 of the plug 138. The friction reducing means 210 in this embodiment is a coating that is applied to the outer surfaces 202 of the tapered plug 138 or the inner surfaces 200 of the leaves 140. A suitable coating of anti-friction material is Plasti-Dip manufactured by PDI, Inc., of 3760 Flowerfield Rd., Blaine, Minn. The friction reducing means 210 should have lubricating properties and yet have sufficient strength and rigidity so that it is not entirely displaced from between the surfaces 200 and 202 as the surfaces move relative to each other and expand the shell leaves 140.

Figure 15:
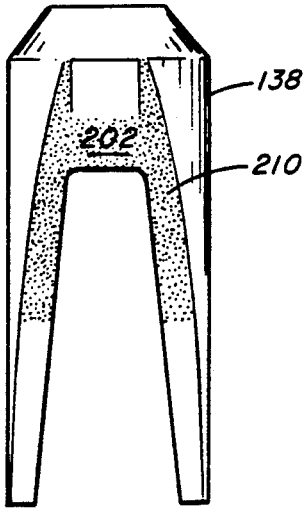
FIG. 15 is a view in elevation of the type of plug used with a mechanical expansion shell of the bail type with the friction reducing means on a sloped surface of the plug.

FIG. 15 illustrates by the shaded portion 210, the position of the coating 210 of plastic-like material applied to the tapered plug 138.

Figure 14:
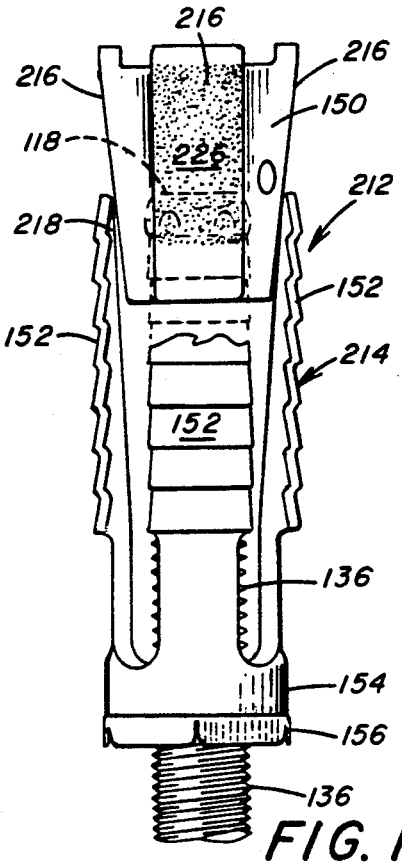
FIG. 14 is a view in front elevation of a mechanical expansion shell and plug on the threaded end of a mine roof bolt. The front leaf of the mechanical expansion shell has been partially removed to show the sloped surface of the plug coated with a friction reducing material and positioned within the leaves of the mechanical expansion shell.

FIG. 14 illustrates another embodiment of an expansion shell assembly with friction reduction applied to a non-bail mechanical expansion shell assembly 212. The mechanical expansion shell assembly 212 includes a mechanical expansion shell 214 and a tapered plug 150. The tapered plug 150 is secured upon the threaded end portion 136 of the bolt shaft first end portion 118. The leaves 152 of the expansion shell 214 are formed integrally with a ring 154. The ring 154 and leaves 152 are supported on the shaft first end portion 118 by a Pal nut or jam nut 156 that is threaded onto threads 136 of the shaft first end portion 118. The tapered plug 150 has its outer tapered or sloped surfaces 216 coated with a friction reducing plastic coating 226 such as Plasti-Dip. The coating of friction reducing material in FIG. 14 could also have been placed on the inner surfaces 218 of the leaves instead of the outer surfaces 216 of the plug 150 or where desired both the inner surface 218 of the leaves 152 and the outer surface 216 of the plug 150 could be coated with the friction reducing material 226. The same arrangement could be done on the respective surfaces of the bail type shell illustrated in FIGS. 11–13 and 15.

It has been found that by utilizing the rigid washer 26 and adjusting its position along the shaft 16 of roof anchors, increased strength is provided to the anchorage with smaller amounts of resin bonding material. As an example, in a bore hole having a diameter of $1\frac{3}{8}$ inches, and utilizing a roof anchor of the type shown in FIGS. 5 and 14, with a resin capsule only 6 inches long, the roof anchor withstood a pulling force of 26,000 pounds without losing anchorage. It is believed this is achieved because the resin is confined to an area between the end of the blind bore hole and the washer 26 and placed under compression so that the pressure of the resin fills the cracks and crevices within the bore hole and more firmly anchors itself to the interior of the blind bore hole.

It has also been found that, by placing a lubricant or friction reducing material with high compressive properties between the leaves of the mechanical expansion shell and the tapered plug, the amount of horizontal force exerted by the leaves of the expansion shell assembly in increased substantially.

The following tabulation of the force exerted on the leaves of the expansion shell at various pull loads on the bolt illustrate the increase in the lateral force on the leaves when a friction reducing or lubricating means is placed between the inner surface of the leaves and the outer surface of the plug. The tabulation is a direct correlation between the torque applied on the bolt to the lateral force exerted by the leaves on the wall of the bore hole. For each foot pound of torque that is applied to the bolt there is 60 pounds of pull on the bolt. The tabulation is expressed in pounds pull on the bolt which can be readily converted to the torque on the bolt.

EXAMPLE

| Shell #1 - Dry | | Shell #2 w/Lubricant | |
|---|---|---|---|
| Pull (Load lbs.) | Leaf Force | Pull (Load lbs.) | Leaf Force |
| 47 | 90 | 47 | 40 |
| | | 94 | 100 |
| | | 117 | 140 |
| 141 | 120 | 141 | 190 |
| | | 164 | 230 |
| 185 | 180 | 185 | 280 |
| 211 | 200 | 211 | 320 |
| 235 | 220 | 235 | 370 |
| 258 | 250 | 258 | 420 |
| 282 | 270 | 282 | 470 |
| 305 | 300 | 305 | 530 |
| 329 | 330 | 329 | 590 |
| 376 | 380 | 376 | 660 |
| 423 | 420 | 423 | 730 |
| 470 | 460 | 470 | 890 |
| 517 | 520 | 517 | 1020 |
| 564 | 570 | 564 | 1130 |
| 611 | 630 | 611 | 1230 |
| 658 | 670 | 658 | 1320 |
| 705 | 750 | 705 | 1430 |
| 752 | 800 | 752 | 1510 |
| 799 | 850 | 799 | 1640 |
| 1034 | 1040 | 1034 | 2080 |
| 1269 | 1270 | 1269 | 2630 |
| 1504 | 1490 | 1504 | 3170 |
| 1739 | 1710 | 1739 | 3860 |
| 1974 | 1910 | 1974 | 4340 |
| 2209 | 2160 | 2209 | 4860 |
| 2914 | 2890 | 2914 | 6060 |
| 3149 | 3270 | 3149 | 6360 |
| 3384 | 3510 | 3384 | 6690 |
| 3619 | 3810 | 3619 | 7360 |
| 3854 | 4080 | 3854 | 7640 |
| 4089 | 4500 | 4089 | 7960 |
| 4324 | 4780 | 4324 | 8240 |
| 4559 | 5000 | 4559 | 8500 |
| 5029 | 5850 | 5029 | 8960 |
| 5499 | 6840 | 5499 | 9220 |
| 5969 | 7720 | 5969 | 9830 |
| 6439 | 9420 | | |

The tabulation illustrates at a pulling force of 1269 lbs. or a torque of 21.15 ft pounds without the friction reducing means between the surfaces, the lateral force on the leaf is 1270 lbs., whereas at the same pulling force or torque of the bolt that has the friction reducing means, the lateral force is increased to 2630 lbs. At a pulling force of 611 lbs. without lubricant, the lateral force is 630 lbs. and with lubricant is increased to 1230 lbs.

Figure 16:
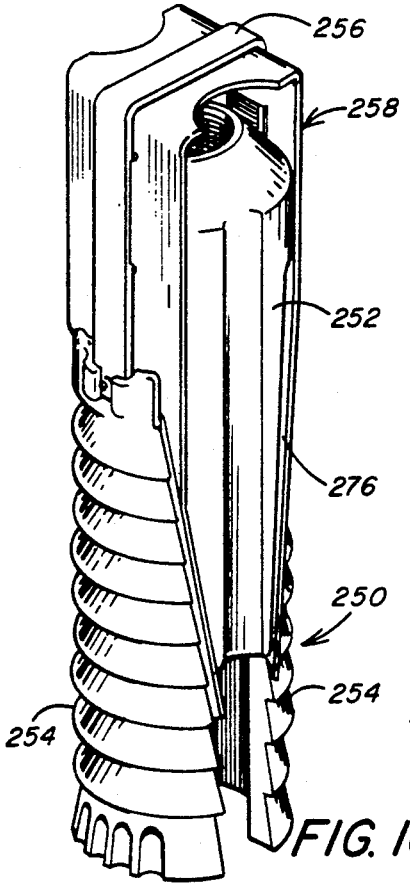
FIG. 16 is a perspective view of a bail type expansion shell assembly with a strip of friction reducing material positioned between the plug outer sloped surface and the inner surface of the expansion leaves.

Referring to FIGS. 16–21, another embodiment of the friction reducing means is illustrated. FIG. 16 illustrates an assembled bail type shell assembly generally designated by the numeral 250 which includes a tapered plug 252 and a pair of expansion leaves 254 connected to each other by means of a bail 256 extending over the upper portion of the plug 252.

Figure 17:
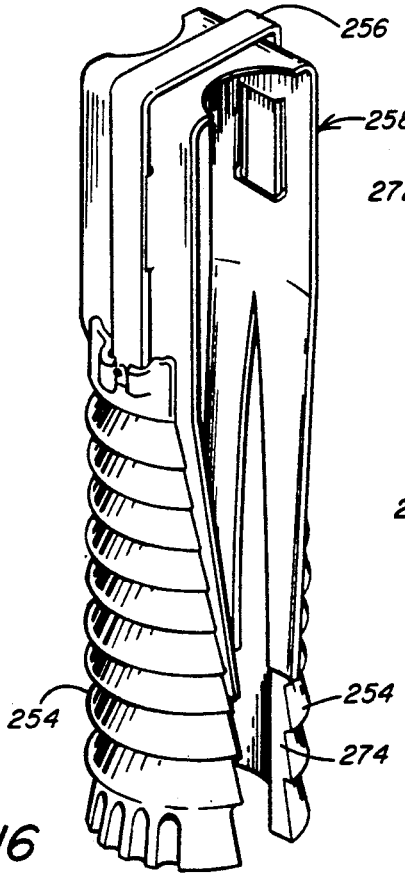
FIG. 17 is a view similar to FIG. 16 with the plug removed to more clearly illustrate the strip of friction reducing material.

FIG. 17 illustrates the expansion leaves 254 connected to the bail 256 and the tapered plug 252 is omitted to better illustrate the friction reducing strip generally designated by the numeral 258.

Figure 18:
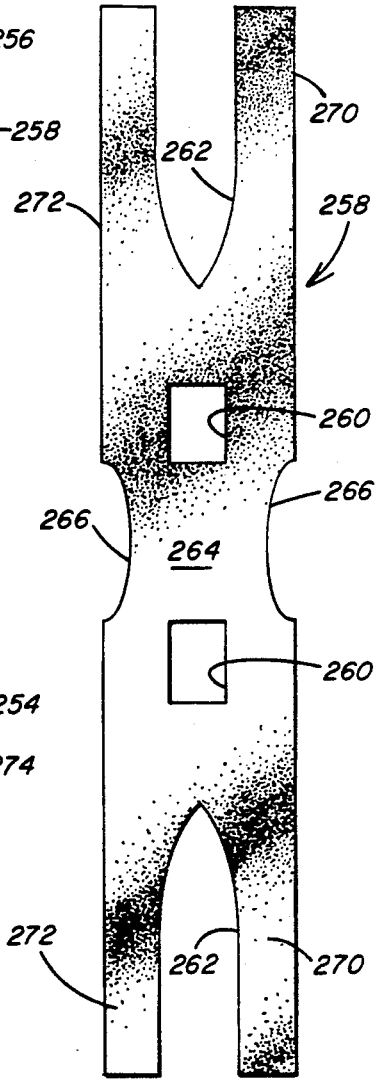
FIG. 18 is a plan view of the strip of friction reducing material.

The friction reducing strip is illustrated in FIG. 18 and has a generally flat configuration and is preferably formed from a friction reducing material such as polyethylene and has a thickness of preferably 1/32 of an inch. The friction reducing strip 258 has a pair of rectangular openings 260 and a pair of slots 262 formed in the ends of the strip body portion 264. There are also a pair of cutaway portions 266 along the sides of the strip 258. The openings 260 permit the bail 256 to abut the side wall of the tapered plug portion adjacent its upper portion and the slots 262 permit the legs 270 and 272 to abut the inner surface 274 of the expansion leaves 254. The position of the strip of friction reducing material is illustrated in FIG. 17 with the legs 270 and 272 in overlying relation with the edges 274 of the expansion leaves 254.

With the above arrangement, the end of the bolt is threadedly engaged in the tapered plug 252 and rotation of the bolt relative to the tapered plug 252 and expansion shell 254 moves the plug 252 downwardly relative to the expansion leaves 254 and moves the serrated portion of the expansion leaves into engagement with the bolt hole wall. With the friction reducing strip positioned as illustrated in FIGS. 16 and 17, the tapered plug surface 276 abuts the friction reducing strip legs 270 and 272 and is in sliding relation therewith. The other surface of the legs 270 and 272 are in abutting relation with the surfaces 274 of the expansion leaves 254 so that the friction reducing strip 258 is positioned between the surfaces of the tapered plug 252 and the expansion leaves 254. The friction reducing strip 258 reduces the friction between the expansion leaves 254 and the plug 252 as the plug 252 expands the expansion leaves 254 into engagement with the bolt hole wall and thus as previously described, reduces the torque requirements for the expansion shell assembly 258 to expand and engage the bolt hole wall.

Figure 19:
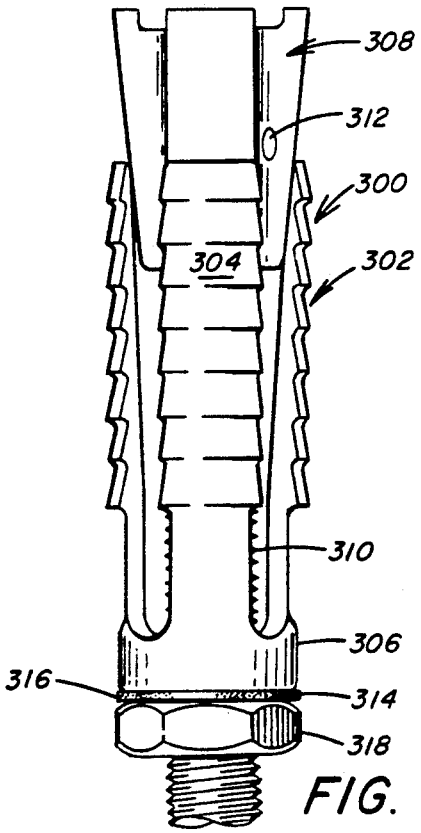
FIG. 19 is a view in elevation of an expansion shell assembly with a friction reducing material between the bottom of the expansion shell and the upper surface of the jamb nut.
Figure 20:
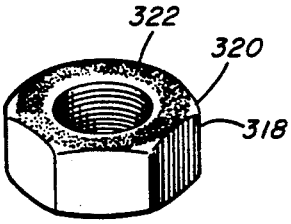
FIG. 20 is a perspective view of a jamb nut with a coating of friction reducing material on its upper surface.
Figure 21:
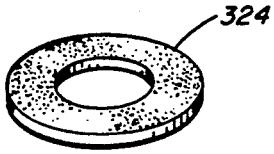
FIG. 21 is a perspective view of a washer fabricated from a friction reducing material and arranged to be positioned between the bottom surface of the expansion shell and the top surface of the jamb nut.

FIGS. 19, 20 and 21 illustrate another embodiment of a friction reducing means utilized with an expansion shell assembly generally designated by the numeral 300. The expansion shell assembly 300 has an expansion shell 302 with a plurality, preferably four, expansion fingers 304, which are connected to each other by a ring member 306 located at the base of the fingers 304. The fingers 304 extend upwardly from the ring member 306 and are arranged to expand into engagement with the bolt hole wall. A tapered plug 308 is threadedly secured to the bolt end portion 310 and may include a bore 312 for a shear pin as previously discussed. The lower surface of the ring portion 306 of the expansion shell 302 has an under surface 314 which abuts a friction reducing means 316 and a PAL nut or jamb nut 318 is threadedly secured on the bolt threaded end portion 310 with the friction reducing means 316 between the lower surface of the expansion shell ring 308 and the upper surface of the jamb nut 318. Although not illustrated in this embodiment of FIG. 19 it should be understood that a lubricating means such as a coating of lubricant or strips of lubricating material may be positioned between portions of the inner surface of the leaves 304 and the portions of the outer surface of the plug 308 as previously described.

FIG. 20 illustrates a jamb nut 318 with its upper surface 320 coated with a friction reducing material 322 similar to the friction reducing coating previously described. Another embodiment of the friction reducing means is a circular disc or washer 324 formed from polyethylene material similar to that for the friction reducing strip 258. The washer 324 may be utilized as the friction reducing means 316 illustrated in FIG. 19 or the nut 318 may have a friction reducing coating 22 applied to the upper surface of the nut.

It has been found that there is a substantial reduction in torque obtained by utilizing the friction reducing means 316 between the expansion shell ring 306 and the jamb nut 318.

According to the provisions of the Patent Statutes, we have explained the principal, preferred construction, and mode of operation of our invention and have illustrated and described what we now consider to represent its best embodiments. However, it should be understood that, within the scope of the appended claims, the invention may be practiced otherwise than as specifically illustrated and described.

We claim:

1. A roof anchor for supporting an underground mine roof or the like comprising:

an elongated shaft having first and second end portions, said shaft operable to be positioned in a bore hole in a mine roof, said bore hole having an open end portion at said mine roof and a blind closed end portion in the strata above said mine roof;

said shaft first end portion having an expansion shell assembly positioned thereon, mechanical expansion shell assembly including a tapered plug threaded onto said shaft first end portion, and an expansion shell having at least two leaves, each leaf having an inner surface and an outer surface, said tapered plug having a plurality of sloped outer surfaces abutting said inner surfaces of aid expansion shell;

a plastic-like friction reducing means positioned between said sloped outer surfaces of the plug and said inner surfaces of the leaves, said friction reducing means having sufficient rigidity so that at least a portion of said friction reducing means remains between said sloped outer surfaces of said plug and said inner surfaces of said leaves during the expansion of said expansion shell into engagement with the inner wall of said bore hole;

said shaft first end portion with said expansion shell assembly positioned thereon arranged to be inserted into said bore hole formed in said roof;

a preselected volume of a resin bonding material positioned in said bore hole in capsule form above said shaft front end portion, said resin bonding material arranged to bond said shaft first end portion to the inner wall of the bore hole;

said shaft second end portion having means cooperating therewith operable to bear against said mine roof at said open end portion and an enlarged end portion arranged to rotate said shaft in said bore hole;

annular stop means engaged to said elongated shaft at a preselected location along said shaft so that said annular stop means, upon insertion of said shaft first end portion with said expansion shell assembly positioned thereon into said bore hole, exerts a compressive force on said preselected volume of said resin bonding material positioned thereabove in said bore hole before said resin bonding material has set and maintains a compressive force on said bonding material;

said expansion shell assembly, upon rotation of said shaft in said bore hole, arranged to exert a further compressive force on at least a portion of said resin bonding material before said resin bonding material has set and expands said expansion shell to engage the inner wall of said bore hole and provide a tension on said roof anchor shaft; and said compressive force and said further compressive force maintained on said resin bonding material until said resin bonding material has set.

2. A roof anchor as set forth in claim 1 wherein said annular stop means comprises a rigid annular washer loosely surrounding said shaft and having an outer edge extending into close proximity to the inner wall of said bore hole, and a circular spring wire clamp having actuating ears whereby said spring wire clamp is spring loaded to be compressed around said roof anchor shaft at a point closer to said shaft second end portion than said rigid annular washer, said clamp being arranged to be released from said shaft by forcing said ears toward each other.

3. A roof anchor as set forth in claim 1 wherein said annular stop means is secured in a preselected position on said shaft before said anchor is inserted into said bore hole so that the preselected volume of said resin bonding material used to secure said roof anchor to said bore hole inner wall is less than the volume of the space within said bore hole blind end portion above said stop means, not occupied by said roof anchor so that pressure is exerted on said resin bonding material within said bore hole before said resin bonding material sets.

4. A roof anchor as set forth in claim 1 wherein said friction reducing means includes a plastic generally rigid material having lubricating properties and compressive properties to maintain at least a portion of said friction reducing means between the surfaces of the plug and leaves during expansion of the leaves.

5. A roof anchor as set forth in claim 1 wherein said friction reducing means includes strips of a material having lubricating properties.

6. A roof anchor as set forth in claim 1 wherein the friction reducing means comprises a generally rigid plastic coating covering at least a portion of said slanted outer surfaces of said plug.

7. A roof anchor as set forth in claim 1 wherein the friction reducing means comprises a layer of generally rigid plastic coating covering at least a portion of said inner surfaces of said leaves.

8. A method of supporting an underground mine roof or the like comprising:

forming a blind bore hole upwardly in a mine roof, said blind bore hole having a wall and a closed blind end portion in the strata above the mine roof;

inserting into said blind bore hole a preselected volume of resin bonding material contained in an unmixed condition within a destructible resin capsule with components of said resin bonding material being confined within separate compartments of said capsule;

providing a roof anchor which includes a shaft with first and second end portions, an annular stop means on said shaft at a point intermediate between said first and second end portions, a bolt head on said second end portion and a mechanical expansion shell assembly having an expansion shell having at least two leaves surrounding a tapered plug threaded onto said shaft first end portion, and a plastic-like friction reducing means located between said tapered plug and said leaves having sufficient rigidity so that at least a portion of said friction reducing means remains between said sloped outer surface of said plug and said inner surface of said leaves;

securing said annular stop means on said roof anchor shaft at a preselected location on said shaft between said first and second end portions to provide a volume of space between said stop means on said shaft and said closed blind end portion of said bore hole that is not occupied by said roof anchor and expansion shell assembly and is less than the volume of said resin bonding material;

inserting aid roof anchor first end portion in said blind bore hole and moving said first end portion upwardly in said blind bore hole toward said closed blind end portion;

fracturing said resin capsule and said separate compartments therein with said roof anchor shaft first end portion and urging said roof anchor upwardly in said bore hole and compressing said resin by said annular stop means before said resin hardens;

rotating said roof anchor to mix said components of said resin bonding material within said bore hole while compressing said resin and expanding said expansion shell into contact with the inner wall of said bore hole to further compress said resin while maintaining at least a portion of said friction reducing means between the surface of said plug and the inner surfaces of said leaves; and permitting said resin to set while being compressed by said annular stop means and said expansion shell assembly with said bolt head formed on the second end portion of said roof anchor shaft supporting a roof support plate surrounding said bore hole and abutting said mine roof.

9. A method of supporting an underground mine roof as set forth in claim 8 wherein the friction reducing means includes a generally rigid plastic material having lubricating properties and compressive properties to maintain at least a portion of said friction means between the surfaces of the plug and leaves during expansion of the leaves.

10. A method of supporting an underground mine roof as set forth in claim 8 wherein the friction reducing means includes a generally rigid coating of a plastic-like material covering at least a portion of the slanted outer surface of said plug.

11. A method of supporting an underground mine roof as set forth in claim 8 wherein said annular stop means includes a generally rigid coating of a plastic-like material covering at lest a portion of said inner surfaces of said leaves.

12. The method of supporting an underground mine roof as set forth in Claim 8 wherein said annular stop means is secured to said roof anchor shaft by sliding a circular spring wire clamp along said shaft to the desired position with the clamp being open while being positioned on said shaft;

thereafter permitting said clamp in the desired position to engage and grip said shaft, and thereafter sliding a loose-fitting rigid annular washer along said shaft into contact with said clamp with said washer being closer to said shaft first end portion than said spring wire clamp.

* * * * *